US012708937B2

(12) United States Patent
Shiyan et al.

(10) Patent No.: US 12,708,937 B2
(45) Date of Patent: Aug. 18, 2026

(54) METHOD FOR PRODUCING A METAL POWDER, COMPRISING AN ELECTRIC EXPLOSION OF A PIECE OF A STEEL WIRE

(71) Applicant: Fedor Zotov, Granada Hills, CA (US)

(72) Inventors: Lyudmila Nikolaevna Shiyan, Tomsk (RU); Galina Leonidovna Lobanova, Tomsk (RU); Alexey Vitalievich Pustovalov, Tomsk (RU); Mikhail Alexandrovich Buldakov, Tomsk (RU); Tatiana Alexandrovna Yurmazova, Tomsk (RU); Fedor Zotov, Granada Hills, CA (US); Dmitry Igorevich Shvartsman, Tomsk (RU)

(73) Assignee: Fedor Zotov, Granada Hills, CA (US)

( * ) Notice: Subject to any disclaimer, the term of this patent is extended or adjusted under 35 U.S.C. 154(b) by 536 days.

(21) Appl. No.: 18/259,171

(22) PCT Filed: Jan. 10, 2022

(86) PCT No.: PCT/RU2022/050004
§ 371 (c)(1),
(2) Date: Jun. 23, 2023

(87) PCT Pub. No.: WO2022/149999
PCT Pub. Date: Jul. 14, 2022

(65) Prior Publication Data

US 2024/0051020 A1 Feb. 15, 2024

(30) Foreign Application Priority Data

Jan. 11, 2021 (RU) ..... 2021100395

(51) Int. Cl.
*B22F 9/14* (2006.01)
*B22F 1/054* (2022.01)
*B22F 9/04* (2006.01)

(52) U.S. Cl.
CPC ..... *B22F 9/14* (2013.01); *B22F 1/054* (2022.01); *B22F 9/04* (2013.01); *B22F 2201/04* (2013.01);
(Continued)

(58) Field of Classification Search
CPC ..... B22F 9/04; B22F 9/08–10; B22F 9/14; B22F 2201/04; B22F 2201/20
See application file for complete search history.

(56) References Cited

U.S. PATENT DOCUMENTS

| | | | | |
|---|---|---|---|---|
| 6,398,125 | B1 | 6/2002 | Liu et al. | |
| 2003/0102207 | A1 | 6/2003 | Wu et al. | |
| 2021/0197263 | A1* | 7/2021 | Weber | B29C 64/314 |

FOREIGN PATENT DOCUMENTS

| | | |
|---|---|---|
| EP | 3895831 A1 | 10/2021 |
| RU | 2048277 C1 | 11/1995 |

(Continued)

OTHER PUBLICATIONS

International Search Report for International Application No. PCT/RU2022/050004 mailed Jun. 3, 2022.

(Continued)

*Primary Examiner* — Sally A Merkling
*Assistant Examiner* — Sean P. O'Keefe
(74) *Attorney, Agent, or Firm* — Perilla Knox & Hildebrandt; Kenneth A. Knox

(57) ABSTRACT

A method for producing a metal powder, comprising an electric explosion of a piece of a steel wire carried out inside a reactor at a pressure of a gaseous medium of $10^{-5}$ Pa and its forced circulation, characterized in that the method further comprises a pre-evacuation of a volume contained inside the reactor and pipes connecting it to a cyclone, whose lower part is equipped with a hopper, to a residual pressure of $10^{-2}$ Pa, then it is filled with carbon monoxide to (Continued)

a pressure of $10^5$ Pa at a gas flow rate of 10 m/s at a reactor inlet, the electric explosion of the steel wire made of low-carbon steel is then carried out at a specific energy of 7-18 kj/g and a pulse duration of 1,2-2 μs, products of the electric explosion are extracted by gas flow through the cyclone into the hopper to deposit, once the hopper is filled, the process is halted, the hopper is disconnected from the cyclone, closed with a lid with an opening, and kept in this state for at least 48 hours, the resulting powder is then removed and placed into a container for storage.

20 Claims, 4 Drawing Sheets

(52) U.S. Cl.
CPC ..... *B22F 2304/10* (2013.01); *B22F 2999/00* (2013.01)

(56) References Cited

FOREIGN PATENT DOCUMENTS

| | | | | | |
|---|---|---|---|---|---|
| RU | 2560432 | C2 | | 8/2015 | |
| RU | 2675188 | C1 | | 12/2018 | |
| RU | 2686679 | C2 | | 4/2019 | |
| RU | 2699886 | C1 | * | 9/2019 | ..... B22F 9/14 |
| RU | 2709304 | C1 | * | 12/2019 | ..... C22C 1/00 |
| RU | 2754617 | C1 | | 9/2021 | |
| TW | 201714685 | A | * | 5/2017 | |

OTHER PUBLICATIONS

Written Opinion for International Application No. PCT/RU2022/050004 mailed Jun. 3, 2022.

International Search Report for International Application No. PCT/RU2022/050003 mailed May 20, 2022

Written Opinion for International Application No. PCT/RU2022/050003 mailed May 20, 2022.

Pustovalov Alexey V. et al: "Production of Iron Nanopowders by the Electric Explosion of Wire", Advanced Materials Research, vol. 1097, Jan. 1, 2015 (Jan. 1, 2015), pp. 3-7, XP055919013, DOI: https://www.scientific.net/AMR.1097.3.

Liu Lin et al: "Iron-Based Nanopowders Containing [alpha]-Fe, Fe 3 C, and [gamma]-Fe Particles Synthesised in Microwave Torch Plasma and Investigated with Mossbauer Spectroscop", Japanese Journal of Applied Physics Jpn. J. Appl. Phys, Jan. 1, 2011 (Jan. 1, 2011), XP055919381, Retrieved from the Internet: URL: https://iopscience.iop.org/article/10.1143/JJAP.50.08JF11/pdf.

Chen Zhang et al: "Synthesis of Iron Nanometallic Glasses and Their Application in Cancer Therapy by a Localized Fenton Reaction", Angewandte Chemie, Wiley—V CH Verlag Gmbh & Co. KGAA, DE, vol. 128, No. 6, Jan. 6, 2016 (Jan. 6, 2016), pp. 2141-2146, XP071370226, ISSN: 0044-8249, DOI: 10.1002/ANGE.201510031 the whole document & Zhang Chen et al: "Supporting Information Synthesis of Iron Nanometallic Glasses and Their Application in Cancer Therapy by a Localized Fenton Reaction", Angewandte Chemie, Jan. 1.

* cited by examiner

METHOD FOR PRODUCING A METAL POWDER, COMPRISING AN ELECTRIC EXPLOSION OF A PIECE OF A STEEL WIRE

CROSS-REFERENCE TO RELATED APPLICATIONS

This application is a national phase application under 35 U.S.C. § 371 of International Application No. PCT/RU2022/050004 filed Jan. 10, 2022, entitled "A METHOD FOR PRODUCING A METAL POWDER, COMPRISING AN ELECTRIC EXPLOSION OF A PIECE OF A STEEL WIRE," which claims the benefit of and priority to Russian Federation patent application No. 2021100395 filed Jan. 11, 2021, the contents of both of which being incorporated by reference in their entireties herein.

TECHNICAL FIELD

The invention present disclosure relates to the field of powder metallurgy, namely, to the production of powder materials containing a mixture of nano and micro particles and, in particular, for the production of powder materials from low-carbon steel wire for additive manufacturing technologies, for mechanical parts, low-temperature, high-strength solders, magnetic materials, catalysts, sorbents, dyes, additives to oils, polymeric materials, and other valuable products.

BACKGROUND

A known method for producing highly dispersed powders of inorganic substances [RU 2048277 C1, MDK B22F9/14 (1995.01), publ. 20.11.1995] entails the explosion of metal workpieces under a current pulse in a gaseous medium at an elevated pressure. Metal workpieces with a diameter of 0.2-0.7 mm are used. The process is carried out with a current pulse at an energy density equal to 0.9 of the metal sublimation energy to its ionization energy transferred to the workpiece for no more than 15 μs a gaseous medium under a pressure of 0.5-10.0 atm. Metals or alloys having an ionization energy to sublimation energy ratio equal to or greater than 0.9 and a liquid-solid metal resistivity ratio equal to or greater than 1 are used as the workpieces in the process. The metals that can be used include aluminum, tin, copper, silver, nickel, iron, tungsten, molybdenum, brass, nickel-chromium, iron-nickel. The gases that can be used include hydrogen, helium, argon or from the group air, nitrogen, acetylene, or their mixtures with argon or helium, are used as a gaseous medium.

As a result, powders of inorganic substances are obtained, their particles are structurally inhomogeneous, contain zones of a powder of an ordered structure and zones of a powder in an X-ray pomorphic state. The average particle size is 0.04-0.3 microns.

BRIEF SUMMARY

A known method of producing a metal nanopowder [RU 2675188 C1, MDK B22 F9/14 (2006.01), B82Y 30/00 (2011.01), publ. Dec. 17, 2018] was selected as a prototype. It entails an electric explosion of a metal wire inside a reactor, providing forced circulation of a gaseous medium at a gas flow rate in the range from 1.5 m/s to 2.5 m/s inside the reactor. The electric explosion of the wire is carried out at a pressure of the gas medium ranging from 1 to 3 atm inside the reactor. The amount of energy introduced into the wire ranges from 0.6 to 0.9 of the sublimation energy of the metal. The obtained powder particles are then separated with the release of a fine fraction of particles of sizes of less than 5 microns. Metal wires made of heat-resistant, corrosion-resistant alloys (grades XH60BT, 03X16H15M3) with a diameter of 0.4 to 0.65 mm are used. To form a gaseous medium, an atmosphere of argon, nitrogen or helium is used.

The given method produces powder materials containing a mixture of nano and microparticles with particle sizes of less than 5 microns.

The purpose of the proposed disclosure is to expand the arsenal of means for producing metal nanopowders.

The given method for producing a metal powder, as in the prototype, entails an electric explosion of a steel wire inside a reactor at a pressure of a gaseous medium of $10^5$ Pa and its forced circulation.

The volume contained inside the reactor and the pipes connecting it to the cyclone, whose lower part is equipped with a hopper, is pre-evacuated to a residual pressure of $10^{-2}$ Pa. It is then filled with carbon monoxide to a pressure of $10^5$ Pa at a gas flow rate of 10 m/s at the reactor inlet. An electrical explosion of a low-carbon steel wire is carried out at a specific energy of 7-18 KJ/g and a pulse duration of 1.2-2 μs. The products of the explosion are extracted through the cyclone into the sedimentation hopper. Once the latter is filled, the process is halted, the hopper is disconnected from the cyclone, closed with a lid with an opening, and kept in this state for at least 48 hours. The resulting powder is removed and placed in a storage container.

The proposed method of obtaining a metal powder foresees the explosive destruction of a wire made of low-carbon steel by means of a pulsed current. Under the influence of the pulsed current, the wire heats up, melts and explodes. The products of the explosion are a mixture of metal vapors and liquid metal droplets. Upon cooling, the products of the explosion condense into nanometer and micron particles. The resulting metal powder is a mixture of nanoparticles ranging in size from 20 to 300 nm.

The time of the process and the fractional composition of the powder are determined by the value of the specific energy expended on the explosion of a piece of wire. With an increase in the specific energy, the time of the process of the conductor's explosion decreases and the size and number of micron particles decrease, while the size of the nanometer particles practically does not change. When the value of the specific energy expended for achieving the explosion of the wire is below 7 KJ/g, the explosion process lasts more than 2 μs, and the destruction of the wire into large parts occurs, which leads to an increase in the size and number of micron particles. At a specific energy above 18 KJ/g, the explosion process takes place in less than 1.2 μs, the wire explodes more uniformly, and the number of drops and their size decreases. As a result, the size and number of micron particles also decrease, but the excess energy leads to the sintering of the nanometer particles.

In addition, when the metal powder is obtained, a portion of the products of the explosion of the steel wire interacts with the carbon formed during the dissociation of carbon monoxide, leading to the formation of a-Fe and austenite compound in the form of Fe—C.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

2.

Figure 8:
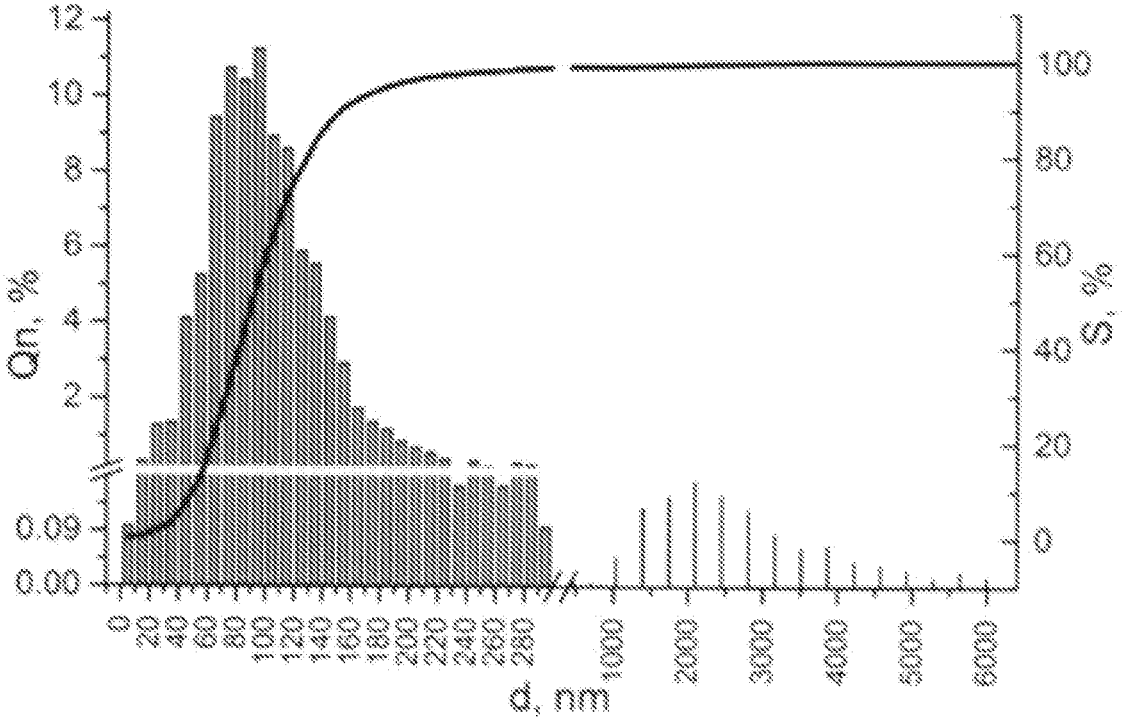

FIG. 8 shows the particle size distribution of the powder obtained in Example 2.

Figure 9:
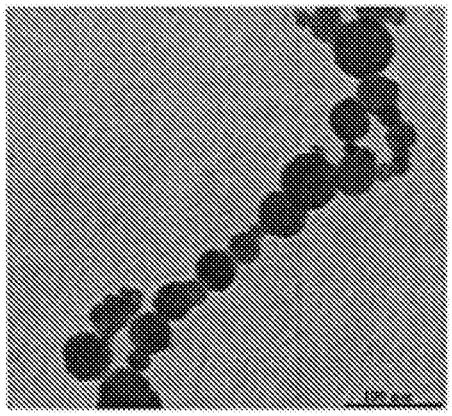
Figure 10:
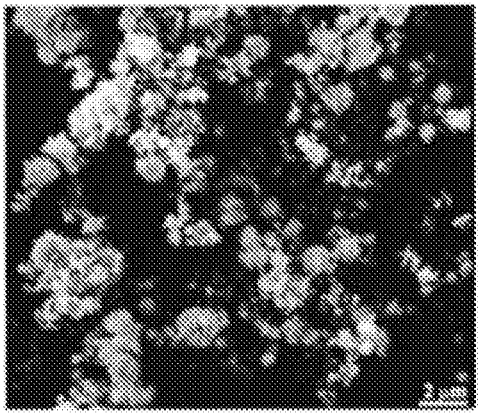

FIGS. 9 and 10 show photographs of the particles of the powder obtained in Example 3.

Figure 11:
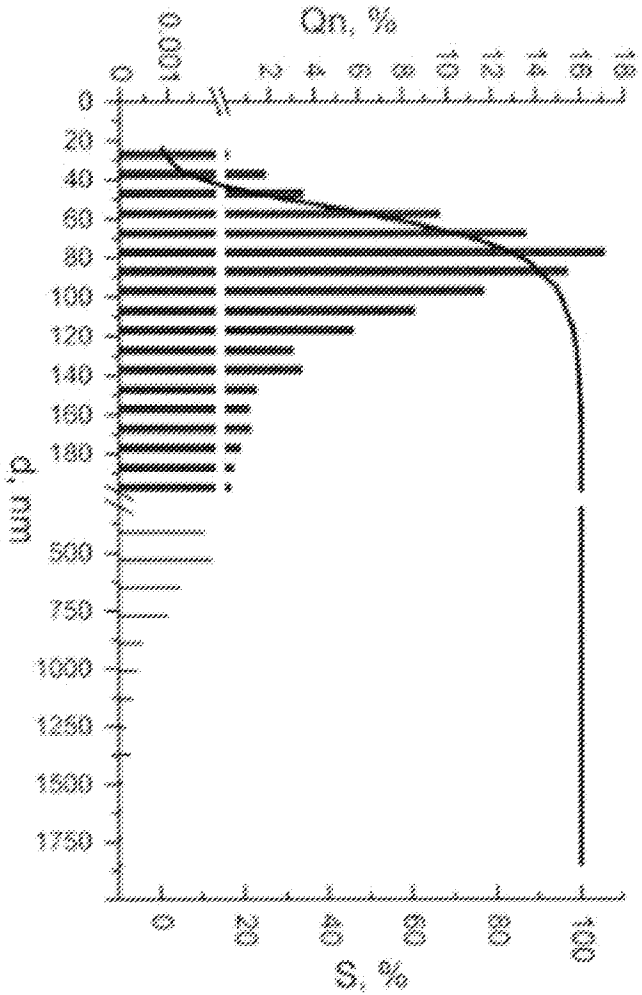

FIG. 11 shows the particle size distribution of the powder obtained in Example 3.

DETAILED DESCRIPTION

The rig for producing the metal powder contains a horizontally installed reactor 1 containing high-voltage 2 and grounded electrodes 3, as well as a feed mechanism 4 of the wire workpiece. The electrode 2 is connected to power supply 5 (PS). The bottom of the reactor 1 is connected by a pipeline to the inlet of a cylindrical cyclone 6, whose lower part is equipped with a hopper 7 for collecting the powder. The outlet of the cyclone 6 is connected to the upper part of the reactor 1 by a pipeline in which the fan 8 is located. The cyclone 6 is connected through the corresponding pipelines equipped with valves to the gas cylinder 9 (GC) containing carbon monoxide, to the foreline pump 10 (FP) and to the valve for discharging the gas.

Example 1

A coil of low-carbon steel wire of SV-08 grade alloy was placed in wire feed mechanism 4 in the reactor 1. The diameter of the wire was 0.3 mm, and the length of the interelectrode gap was 80 mm. Using a foreline pump 10 (FP), the internal volume of the rig was evacuated to a residual pressure of $10^{-2}$ Pa. Then, the working volume of the rig was filled from the gas cylinder 9 (GC) with carbon monoxide to a pressure of $10^5$ Pa. By turning on the fan 8, carbon monoxide was continuously circulated through the pipeline connecting it to the reactor 1 at a speed of 10 mis. After turning on of the feed mechanism 4, a continuous wire feed was injected in the direction from the grounded 10 electrode 3 to the high-voltage electrode 2. A high voltage of 1.5 μs was applied to the high-voltage electrode 2 from the power source 5 (PS). When the wire supplied to the reactor 1 touched the high-voltage electrode 2, it exploded. The specific energy expended was 14 KJ/g. The products of the explosion of the wire were extracted from the reactor 1 by gas flow into the cyclone 6, where they were separated from carbon monoxide and deposited in the hopper 7. The purified gas from the 15 cyclone 6 returned to the inlet of the fan 8 and entered the reactor 1 again. After the hopper 7 was filled with the accumulated products of the wire's explosion, the power source 5 (PS) was turned off, the wire feeder 4, the fan 8 and the hopper 7 were disconnected from the cyclone 6. The hopper 7 was covered with a lid with an opening with a diameter of 1 mm and kept in this state for 48 hours to bring the resulting product into equilibrium. Afterwards, the resulting metal powder was removed from the hopper 7 and placed in a storage container.

Figure 1:
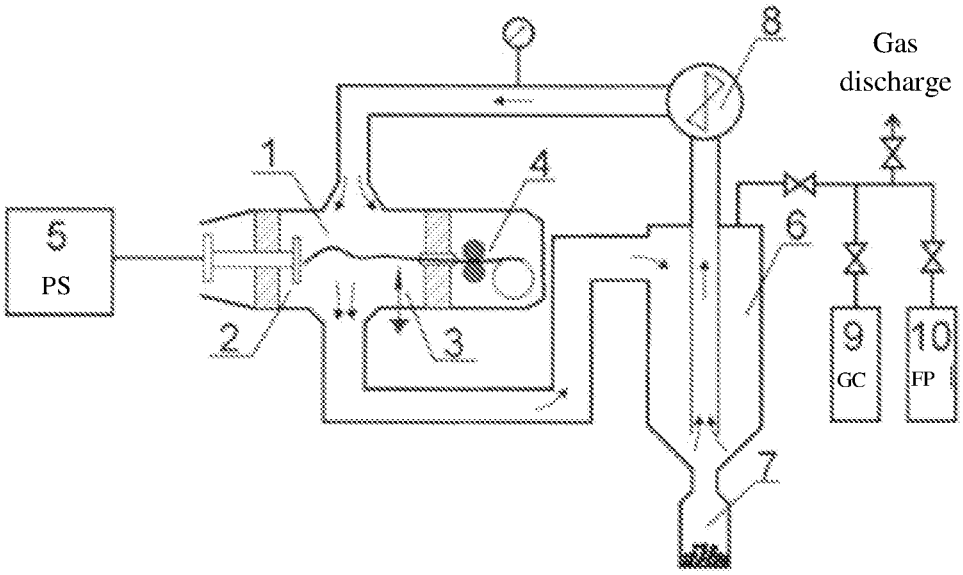
FIG. 1 shows a diagram of the rig for producing a metal powder.
Figures 2, 3:
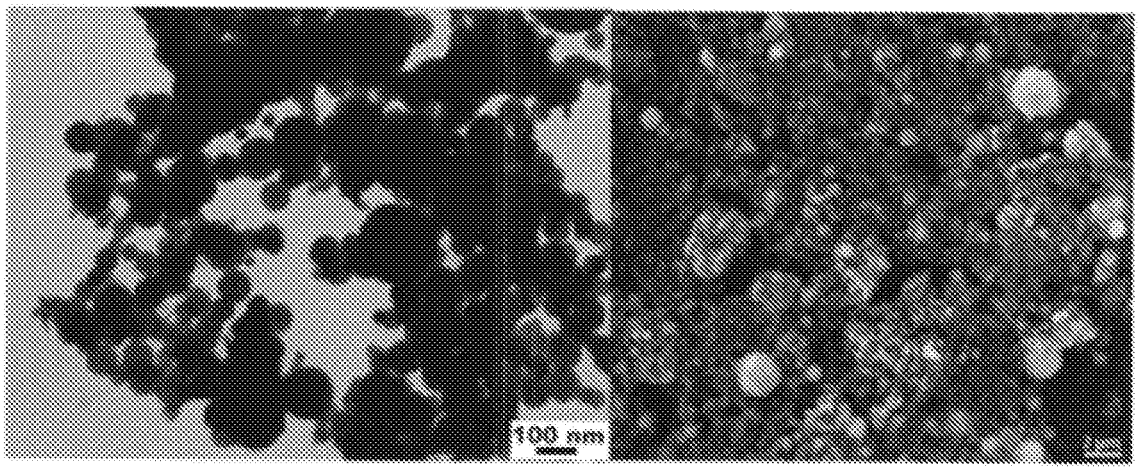
FIGS. 2 and 3 show photographs of the particles of the powder obtained in Example 1.
Figure 4:
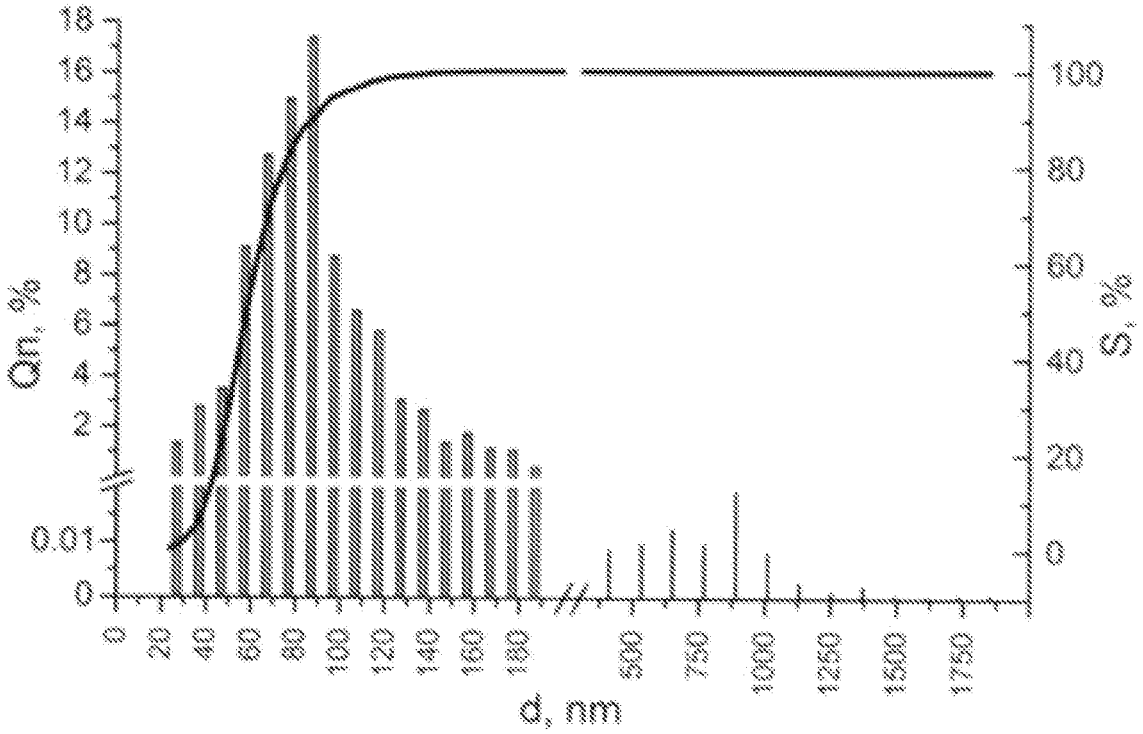
FIG. 4 shows the particle size distribution of the powder obtained in Example 1.

The resulting metal powder is a mixture of nanoparticles ranging in size from 20 to 300 nm (FIG. 2, 3) with a maximum distribution of 80 nm and microparticles with a size of up to 2 μm and a maximum distribution of about 0.8 μm. In this case, the number of particles larger than 500 nm does not exceed 25 1% (FIG. 4).

Figure 5:
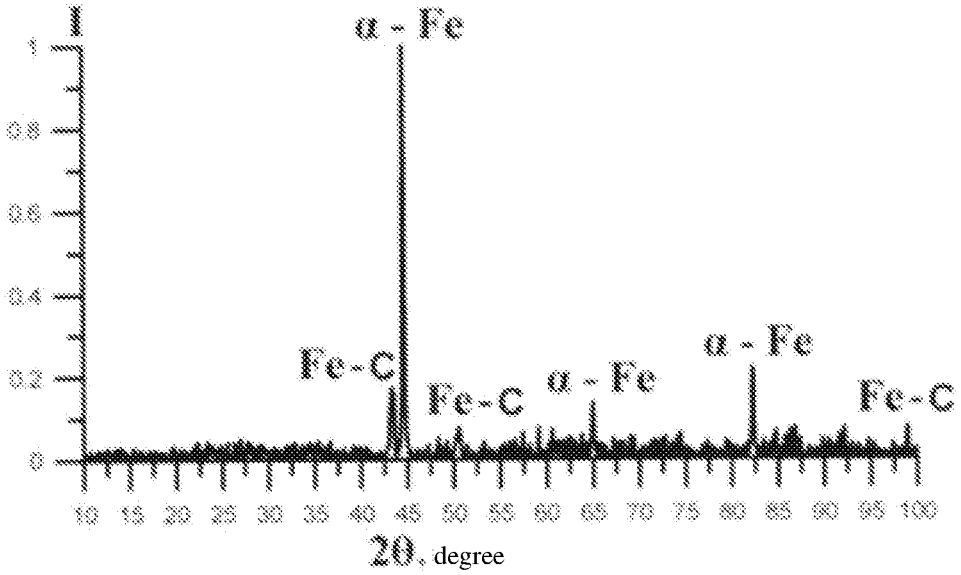
FIG. 5 shows an X-ray diffraction pattern obtained in Example 1 of the powder.

X-ray phase analysis showed that the obtained metal powder consists of pure iron particles in the form of a-Fe phase and austenite compound in the form of Fe—C(FIG. 5). Its specific surface area was 9.3 $m^2/g$.

Example 2

Under conditions similar to Example 1, an electric explosion of a workpiece with a diameter of 0.3 mm and a length of 80 mm was carried out on a low-carbon steel wire of SV08 grade alloy at an energy supply of 7 KJ/g for 2 μs.

Figure 6:
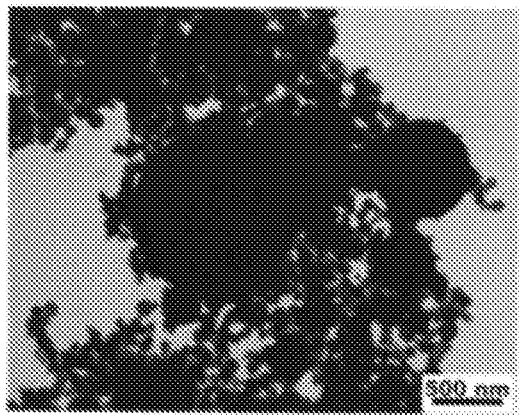
FIGS. 6 and 7 are photographs of the particles of the powder obtained in Example
Figure 7:
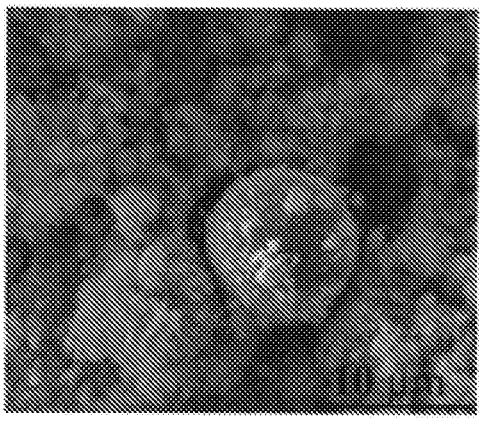

The corresponding images of the resulting powder particles are shown in FIGS. 6 and 7. The powder is a mixture of micron particles with a size of up to 6 microns and a maximum distribution of 2 microns and nanometer particles with a size of 20 to 300 nm with a maximum distribution of 80 nm. The number of particles larger than 500 nm is more than 2% (FIG. 8). The phase composition of the resulting powder is the same as in Example 1 (FIG. 5). The specific surface area of this powder was 4 m2/g.

Example 3

Under conditions similar to Example 1, an electric explosion of a workpiece with a diameter of 0.3 mm and a length of 80 mm was carried out on a low-carbon steel wire of SV08 grade alloy at an energy supply of 18 KJ/g for 1.2 μs.

The corresponding images of the resulting powder particles are shown in FIGS. 9 and 10. The resulting powder is a mixture of micron particles with a size of up to 2 μm and a maximum distribution of 500 nm and partially sintered nanoscale particles with a size of 20 to 300 nm with a maximum distribution of 80 nm. The number of particles larger than 500 nm is not more than 0.5% (FIG. 11). The phase composition of the powder is the same as in Example 1 (FIG. 5). The specific surface area of this metal 25 powder was 11 $m^2/g$.

The above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

The invention claimed is:

1. A method for producing a metal powder, comprising:

carrying out an electric explosion of a piece of a steel wire made of low-carbon steel inside a reactor at a pressure of a gaseous medium of $10^5$ Pa providing forced circulation of the gaseous medium at a first predetermined gas flow rate;

providing a cyclone, wherein the cyclone comprises a lower part that is equipped with a hopper;

performing a pre-evacuation of a volume contained inside the reactor and pipes connecting the reactor to the cyclone to a residual pressure of $10^{-2}$ Pa;

filling the reactor and the pipes with carbon monoxide to a predetermined pressure at a second predetermined gas flow rate at a reactor inlet;

carrying out the electric explosion of the steel wire made of low-carbon steel at a specific energy of 7-18 KJ/g and a pulse duration of 1.2-2 μs;

extracting products of the electric explosion by gas flow through the cyclone into the hopper for deposit;

maintaining a state of the hopper for at least 48 hours to obtain a resulting metal powder; and removing the resulting metal powder.

2. The method according to claim 1, wherein the first predetermined gas flow rate is in a range of 1.5 m/s to 2.5 m/s.

3. The method according to claim 1, wherein the second predetermined gas flow rate is 10 m/s.

4. The method according to claim 1, wherein the predetermined pressure is $10^5$ Pa.

5. The method according to claim 1, further comprising, once the hopper is filled, halting the process of producing the metal powder, disconnecting the hopper from the cyclone, and closing the hopper with a lid with an opening.

6. The method according to claim 1, further comprising placing the resulting powder into a container for storage.

7. The method according to claim 1, wherein the steel wire made of low-carbon steel comprises SV-08 grade alloy.

8. The method according to claim 1, wherein the steel wire has a diameter of 0.3 mm.

9. The method according to claim 1, wherein an inter-electrode gap in the reactor has a length of 80 mm.

10. The method according to claim 1, wherein the resulting metal powder comprises a mixture of nanoparticles ranging in size from 20 to 300 nm and microparticles with a size of up to 2 μm.

11. The method according to claim 1, wherein the resulting metal powder comprises pure iron particles in the form of α-Fe phase and austenite compound in the form of Fe—C.

12. The method according to claim 1, wherein the resulting metal powder has a specific surface area in a range of 4 m2/g to 11 m2/g.

13. A method for producing a metal powder, comprising:

carrying out an electric explosion of a piece of a steel wire made of low-carbon steel inside a reactor at a pressure of a gaseous medium of $10^5$ Pa and its forced circulation;

performing a pre-evacuation of a volume contained inside the reactor and pipes connecting the reactor to a cyclone, wherein the cyclone comprises a lower part that is equipped with a hopper, to a residual pressure of $10^{-2}$ Pa;

filling the reactor with carbon monoxide to a pressure of $10^5$ Pa at a gas flow rate of 10 m/s at a reactor inlet;

carrying out the electric explosion of the steel wire made of low-carbon steel at a specific energy of 7-18 KJ/g and a pulse duration of 1-2 μs;

extracting products of the electric explosion by gas flow through the cyclone into the hopper for deposit;

once the hopper is filled, halting the process of producing the metal powder, disconnecting the hopper from the cyclone, closing the hopper with a lid with an opening, and maintaining a state of the hopper for at least 48 hours to obtain a resulting metal powder; and removing the resulting metal powder and placing the resulting metal powder into a container for storage.

14. The method according to claim 13, wherein the steel wire made of low-carbon steel comprises SV-08 grade alloy.

15. The method according to claim 13, wherein the steel wire has a diameter of 0.3 mm.

16. The method according to claim 13, wherein an inter-electrode gap in the reactor has a length of 80 mm.

17. The method according to claim 13, wherein the lid with an opening has an opening diameter of 1 mm.

18. The method according to claim 13, wherein the resulting metal powder comprises a mixture of nanoparticles ranging in size from 20 to 300 nm and microparticles with a size of up to 2 μm.

19. The method according to claim 13, wherein the resulting metal powder comprises pure iron particles in the form of a-Fe phase and austenite compound in the form of Fe—C.

20. The method according to claim 13, wherein the resulting metal powder has a specific surface area in a range of 4 m2/g to 11 m2/g.

* * * * *